US005256830A

United States Patent [19]

Takeuchi et al.

[11] Patent Number: 5,256,830

[45] Date of Patent: Oct. 26, 1993

[54] MUSICAL TONE SYNTHESIZING APPARATUS

[75] Inventors: Chifumi Takeuchi; Toshifumi Kunimoto, both of Hamamatsu, Japan

[73] Assignee: Yamaha Corporation, Hamamatsu, Japan

[21] Appl. No.: 581,310

[22] Filed: Sep. 11, 1990

[30] Foreign Application Priority Data

| | | | |
|---|---|---|---|
| Sep. 11, 1989 | [JP] | Japan | 1-235101 |
| Sep. 11, 1989 | [JP] | Japan | 1-235102 |
| Sep. 11, 1989 | [JP] | Japan | 1-235103 |
| Sep. 11, 1989 | [JP] | Japan | 1-235104 |
| Sep. 19, 1989 | [JP] | Japan | 1-242494 |
| Sep. 21, 1989 | [JP] | Japan | 1-245678 |

[51] Int. Cl.[5] ..... G10H 1/08

[52] U.S. Cl. ..... 84/625; 84/630; 84/660; 84/DIG. 10; 84/DIG. 26

[58] Field of Search ..... 84/622, 624, 625, 630, 84/659-662, DIG. 9, DIG. 10, DIG. 26

[56] References Cited

U.S. PATENT DOCUMENTS

| | | | |
|---|---|---|---|
| 3,795,770 | 3/1974 | Kato | 84/723 |
| 4,168,645 | 9/1979 | Squire et al. | 84/603 |
| 4,554,857 | 11/1985 | Nishimoto | 84/622 |
| 4,586,417 | 5/1986 | Kato et al. | 84/630 |
| 4,625,326 | 11/1986 | Kitzen et al. | 381/17 |
| 4,909,121 | 3/1990 | Usa et al. | 84/604 |
| 4,984,276 | 1/1991 | Smith | 381/63 |
| 4,998,281 | 3/1991 | Sakata | 84/630 X |
| 5,000,074 | 3/1991 | Inoue et al. | 84/621 |
| 5,029,509 | 7/1991 | Serra et al. | 84/625 |

FOREIGN PATENT DOCUMENTS

| | | |
|---|---|---|
| 56-28274 | 6/1981 | Japan . |
| 59-19353 | 5/1984 | Japan . |
| 15074 | 3/1989 | Japan . |

OTHER PUBLICATIONS

"Modeling Piano Sound Using Digital Filtering Techniques", Garnett, 1987 ICMC Proceedings.

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus is designed to simulate the acoustic sounds of non-electronic musical instruments. In the non-electronic musical instrument providing the resonator such as the piano and guitar, the produced acoustic sound contains three kinds of sounds, i.e., a direct sound, a resonant sound and a transient sound. Herein, the direct sound is produced directly by playing the instrument, the resonant sound is produced from the resonator based on the direct sound and the transient sound is produced when the impulse to be occurred by playing the instrument propagates through the resonator. Thus, signals simulating these sounds respectively are mixed together so as to produce the synthesized musical tone signal, which well-simulates the acoustic sound.

6 Claims, 8 Drawing Sheets

MUSICAL TONE SYNTHESIZING APPARATUS

BACKGROUND OF THE INVENTION

1. Field of the Invention

The present invention relates to a musical tone synthesizing apparatus which synthesizes musical tones of stringed instrument, percussion instrument and the like.

2. Prior Art

As the well-known conventional musical tone synthesizing apparatus, there is provided a so-called waveform-memory-type musical synthesizer which memorizes several kinds of musical tone waveforms generated from non-electronic musical instruments in a waveform memory, wherein such musical tone waveforms are digitized by effecting the Pulse Code Modulation (PCM). This synthesizer reads digital data corresponding to designated performance information from the waveform memory and then reproduces the musical tone waveform. In general, the non-electronic musical instrument (hereinafter, simply referred to as the acoustic musical instrument) can generate the musical tones full of variety in response to the performance. For example, in case of the wind instrument, the tone color can be slightly varied by varying the blowing pressure applied to its mouth-piece. Therefore, in order to reproduce a plenty of musical tone waveforms by the conventional waveform-memory-type musical synthesizer, quite a large amount of storage capacity must be required for the waveform memory, which affects the operation and construction of the musical synthesizer. Meanwhile, it is possible to reproduce the musical tone waveforms full of variety by mixing plural musical tone waveforms together by effecting the computation or modulation. However, when mixing the musical tone waveforms, the quantity of the operation must be large, which affects the operation of the musical synthesizer.

Thus, there is proposed a musical tone synthesizing apparatus using the electric simulation model which simulates the tone-generation mechanism of the acoustic musical instrument. Herein, by activating such simulation model, it is possible to synthesize the desirable musical tone. For example, as the simulation model of the string-striking instrument such as the piano, the musical tone synthesizing apparatus provides a closed-loop including a delay circuit simulating the propagation delay of the string vibration and a low-pass filter simulating the acoustic loss to be occurred at the string. In the above-mentioned musical tone synthesizing apparatus, the closed-loop is applied with an impulse signal representative of the impulse which is occurred when the hammer strikes the string, and then the closed-loop is subject to the resonance state. Thereafter, the signal circulating the closed-loop is picked up as the musical tone signal. Thus, this apparatus can accurately simulate the phenomenon in which the standing-wave vibration of the string is produced when the hammer strikes the string. Then, such standing-wave vibration of the string is directly radiated into the air so that the musical tone is generated with accuracy. For convenience' sake, such musical tone is called as "direct sound" because it is generated by directly radiating the standing-wave vibration of the string.

In the actual acoustic musical instrument, there is provided a resonator (e.g., acoustic plate of piano, casing of guitar). Therefore, by use of the resonator which resonates the above-mentioned direct sound, the acoustic musical instrument can generate the resonant sound.

Thus, Japanese Paten Publication No. 1-15074 discloses the musical tone synthesizing apparatus capable of reproducing both of the direct sound and resonant sound. In order to reproduce both sounds, this apparatus provides two waveform memories wherein one memory memorizes direct sound waveforms and another memory memorizes resonant sound waveforms. In response to the performance information, both of the direct sound waveform and resonant sound waveform are read out and then mixed together.

Meanwhile, in the string-striking instrument such as the piano, the impulse occurred when the hammer strikes the string propagates toward the acoustic plate so that the resonant sound corresponding to the impulse is to be generated. In case of the stringed instrument such as the guitar, the impulse to be applied to the string by the pick or finger nail is transmitted toward the casing via the bridge portion so that the resonant sound corresponding to the impulse is to be generated. In short, the actual acoustic instrument generates three kinds of sounds, i.e., the direct sound which is generated by directly radiating the standing-wave vibration, resonant sound to be generated from the resonator in accordance with the direct sound and another resonant sound which is generated when the impulse to be applied to the instrument when playing such instrument propagates toward the resonator (hereinafter, such another resonant sound will be referred to as "transient sound"). Then, these three kinds of sounds are mixed together to produce the musical tone, which will be heard by the audience. However, the conventional musical tone synthesizing apparatus can reproduce the above-mentioned direct sound and the resonant sound corresponding to the direct sound but cannot reproduce the transient sound to be generated based on the impulse applied to the instrument when playing the instrument. Thus, there in a problem in that the conventional apparatus cannot reproduce the acoustic sounds of the instruments with accuracy.

In order to eliminate the above-mentioned problem, it is possible to employ the provision of another waveform memory which memorizes the transient sounds picked up from the instruments. In this case, such memorized transient sounds are mixed together with the direct sounds and resonant sounds. However, it is very difficult to pick up such transient sounds from the instruments by the conventional technique. Although such pick-up process of picking up the transient sounds requires much effort, it is impossible to obtain the sufficient transient sounds. When reproducing the transient sounds by the sound source employing the PCM method, the sound quality must depend on the recording accuracy. In some cases, the reproduced transient sounds may offend the ears of the audience.

In the meantime, as known well, a plenty of acoustic musical instruments provide the resonators each of which is used to efficiently radiate the vibration into the air. For example, the piano provides the acoustic plate and guitar provides the casing as the resonator. In short, in the acoustic musical instrument providing the resonator, the string vibration is maintained and efficiently radiated into the air by the resonator. Thus, such acoustic musical instrument can generate the continuous musical tone having the good sound quality in the sufficient tone volume.

For the above-mentioned reason, there is a need to embody the acoustic processing apparatus which can offer the acoustic characteristic as similar to that of the resonator of the acoustic musical instrument.

In general, the acoustic plate of the piano itself has the asymmetric structure, and position relationship between one string and acoustic plate is different from that between another string and acoustic plate. Thus, different resonance effect can be obtained with respect to the vibration of each string. In other words, it can be said that the resonant sound of each string is generated by the different acoustic process in the piano. Therefore, in order to embody the acoustic processing apparatus with accuracy, it is necessary to provide a plenty of resonance circuits each effecting the different acoustic process on each pitch. Thus, there is a problem in that such acoustic processing apparatus must require a large-scale circuit. Similarly, in the instruments other than the piano, the acoustic characteristic of the resonator must be differed with respect to each pitch. In order to reproduce the resonant sounds of the above-mentioned instruments with high fidelity, it is desirable to effect the different acoustic process in response to each pitch.

SUMMARY OF THE INVENTION

It is accordingly a primary object of the present invention to provide a musical tone synthesizing apparatus capable of reproducing the musical tones including the transient sounds generated from the acoustic instruments.

It is another object of the present invention to provide a musical tone synthesizing apparatus capable of effecting the acoustic processes as similar to those of the resonators of the acoustic musical instruments.

In a first aspect of the present invention, there is provided a musical tone synthesizing apparatus comprising:

(a) drive signal generating means for generating a drive signal in response to performance information;

(b) resonance means for generating a resonant sound signal in accordance with the drive signal;

(c) musical tone forming means for forming a musical tone signal in response to the performance information; and (d) mixing means for mixing the resonant sound signal and the musical tone signal together in response to the performance information, whereby an output of the mixing means is picked up as a synthesized musical tone signal.

In a second aspect of the present invention, there is provided a musical tone synthesizing apparatus comprising:

(a) drive signal generating means for generating a drive signal in accordance with performance information;

(b) musical tone forming means for forming a musical tone signal in response to the performance information;

(c) first resonance means for imparting a resonance effect to the musical tone signal to thereby produce a first resonant sound signal;

(d) second resonance means for imparting a resonance effect to the drive signal to thereby produce a second resonant sound signal; and (e) mixing means for mixing the musical tone signal, the first resonant sound signal and the second resonant sound signal together in response to the performance information, whereby an output of the mixing means is picked up as a synthesized musical tone signal.

In a third aspect of the present invention, there is provided a musical tone synthesizing apparatus comprising:

(a) drive signal generating means for generating a drive signal in accordance with performance information;

(b) musical tone forming means for forming a first musical tone signal in response to the performance information;

(c) first mixing means for mixing the drive signal and the first musical tone signal together by a first mixing ratio;

(d) resonance means for imparting a resonance effect to an output of the first mixing means to thereby produce a second musical tone signal; and (e) second mixing means for mixing the first and second musical tone signals together by a second mixing ratio, whereby an output of the second mixing means is picked up as a synthesized musical tone signal.

In a fourth aspect of the present invention, there is provided an acoustic processing apparatus comprising:

(a) a plurality of sound sources for generating a plurality of musical tone signals each containing plural frequency components;

(b) distributing means for distributing the plural frequency components of each of the musical tone signals by a predetermined distribution ratio;

(c) processing means for effecting a different acoustic process on each of the plural frequency components of each musical tone signal to be distributed thereto from the distributing means; and (d) accumulating means for accumulating an output of the processing means, whereby an accumulation result of the accumulating means is outputted as a musical tone signal to which an acoustic effect is imparted.

In a fifth aspect of the present invention, there is provided a musical tone synthesizing apparatus comprising:

(a) drive signal generating means for generating a drive signal in accordance with performance information;

(b) musical tone forming means for forming a first musical tone signal based on the drive signal;

(c) first mixing means for mixing the drive signal and the first musical tone signal together, wherein at least one of the drive signal and the first musical tone signal is subject to a frequency-band limiting process before mixing;

(d) resonance means for imparting a resonance effect to an output of the first mixing means to thereby produce a second musical tone signal; and (e) second mixing means for mixing the first and second musical tone signals together in response to the performance information, whereby an output of the second mixing means is picked up as a synthesized musical tone signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
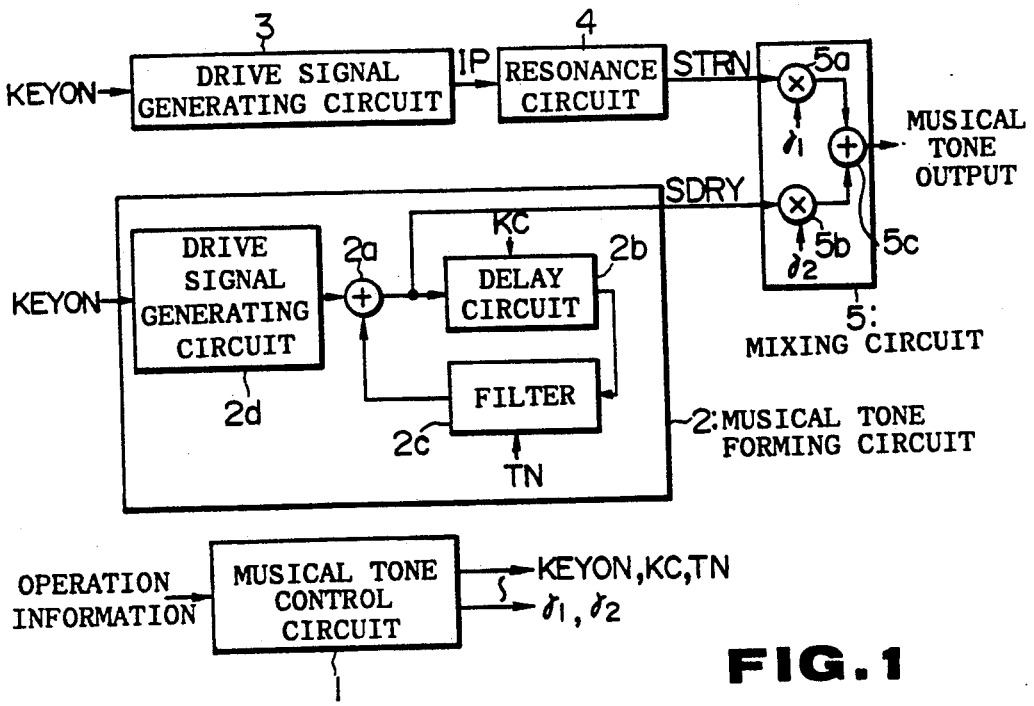
FIG. 1 is a block diagram showing a musical tone synthesizing apparatus according to a first embodiment of the present invention.

Next, description will be given with respect to the preferred embodiments of the present invention in conjunction with the drawings, wherein like reference characters designate like or corresponding parts throughout the several views.

[A] FIRST EMBODIMENT

FIG. 1 is a block diagram showing the musical tone synthesizing apparatus according to the first embodiment of the present invention, wherein a musical tone control circuit 1 generates several kinds of control information in response to operation information inputted thereto. Based on such control information, the present apparatus is to be controlled.

Next, 2 designates a musical tone forming circuit which is designed to form the direct sound corresponding to operation information given by the performer. This musical tone forming circuit 2 includes a closed-loop consisting of an adder 2*a*, a delay circuit 2*b* simulating the propagation delay of the string vibration and a filter 2*c* simulating the acoustic loss of the string. In addition to such closed-loop, this circuit 2 also provides a drive signal generating circuit 2*d* which generates and supplies a drive signal to the closed-loop. The drive signal generating circuit 2*d* contains a waveform memory constructed by a read-only memory (ROM) for storing a time-series digital signal which is obtained by effecting the POM operation on the signal waveforms (such as the impulse waveform) including a plenty of different frequency components. When generating the musical tone, the musical tone control circuit 1 supplies a key-on signal KEYON to the drive signal generating circuit 2*d* within the musical tone forming circuit 2. Then, the digital signals are sequentially read from the waveform ROM, and they are supplied to the adder 2*a* as the foregoing drive signal.

The above-mentioned drive signal circulates through the closed-loop consisting of the adder 2*a*, delay circuit 2*b* and filter 2*c*. This closed-loop functions as the resonance circuit which is in the resonance state at resonance frequencies including a primary resonance frequency and its higher harmonic frequencies. Herein, the primary resonance frequency corresponds to the inverse of the delay time which is required when the drive signal circulates the closed-loop once. By circulating the drive signal through the closed-loop, each of the frequency components of the drive signal is to be emphasized.

The delay circuit 2*b* is designed as a shift register of which delay stage can be changed over, for example. Herein, the delay time of the delay circuit 2*b* is changed over in response to key code information KC supplied from the musical tone control circuit 1. Thus, the primary resonance frequency of the musical tone, i.e., the time required to circulate the drive signal through the closed-loop once can be changed over with respect to each string. In addition, the filter 2*c* is designed as a low-pass filter, for example. In general, each of the strings provided in the piano has different frequency characteristic in the attenuation rate of vibration. For this reason, the musical tone control circuit 1 supplies a tone color parameter TN corresponding to each string to the filter 2*c*. In accordance with the tone color parameter TN, filtering coefficients of the filter 2*c* can be changed over. Thus, the musical tone forming circuit 2 generates a direct sound signal SDRY having the tone color and pitch designated by the musical tone control circuit 1. Incidentally, it is possible to construct the musical tone forming circuit 2 by use of the frequency-modulation (FM) sound source or PCM sound source.

Next, another drive signal generating circuit 3 is also configured as similar to the foregoing drive signal generating circuit 2*d*. When receiving the key-on signal KEYON from the musical tone control circuit 1, the drive signal generating circuit 3 generates a digital impulse signal IP indicating the signal waveform (e.g., impulse waveform) of the impulse to be occurred when the hammer strikes the string in the piano. This impulse signal IP is supplied to a resonance circuit 4.

The resonance circuit 4 simulates the acoustic characteristic of the acoustic plate of the piano. This resonance circuit 4 can be configured by the closed-loop including the delay circuit and filter as similar to the foregoing closed-circuit used in the musical tone forming circuit 2, for example. In general, the acoustic plate of the piano has a plenty of resonance frequencies. Thus, by connecting plural closed-loops each having the different resonance frequency in parallel, it is possible to embody the resonance circuit 4 which simulates the acoustic characteristic of the acoustic plate of the piano with accuracy. This resonance circuit 4 imparts the resonance effect to the impulse signal IP outputted from the drive signal generating circuit 3. As a result, this resonance circuit 4 can output a transient sound signal STRN corresponding to the transient sound which is produced when the impulse applied to the string by the hammer propagates the acoustic plate so that the acoustic plate is resonant with the impulse. Incidentally, the detailed example of the resonance circuit 4 will be described later.

Next, a mixing circuit 5 is configured by multipliers 5a, 5b and an adder 5c. The multiplier 5a receives the foregoing transient sound signal STRN, which is to be multiplied by a coefficient γ1. In addition, the multiplier 5b receives the foregoing direct sound signal SDRY, which is to be multiplied by a coefficient γ2. Herein, both of the coefficients γ1, γ2 are supplied from the musical tone control circuit 1. Then, both of multiplication results of the multipliers 5a, 5b are added together by the adder 5c, which addition result is outputted as the musical tone signal.

Next, description will be given with respect to the operation of the present embodiment by referring to the electronic musical instrument in which a keyboard unit is coupled to the present musical tone synthesizing apparatus. When the key operation is detected in the keyboard unit, the musical tone control circuit 1 outputs the control information such as the tone color parameter TN and the key code information KC which is used to designate the pitch. Based on such control information, the delay time of the delay circuit 2b and the filtering coefficient of the filter 2c are set in the musical tone forming circuit 2. Next, the musical tone control circuit 1 outputs the key-on signal KEYON. As a result, the drive signal generating circuits 2d, 3 are driven, so that the transient sound signal STRN and direct sound signal SDRY are to be generated respectively.

Prior to the above-mentioned operation, the musical tone control circuit 1 outputs the coefficients γ1, γ2 to the multipliers 5a, 5b respectively, which sets the mixing ratio of the transient sound signal STRN and direct sound signal SDRY. In case of the piano, as the pitch becomes higher, the tone volume of the transient sounds becomes higher. Therefore, these coefficients γ1, γ2 are set such that as the pitch becomes higher, the coefficient γ1 becomes larger with respect to another coefficient γ2. Thus, it is possible to generate the musical tone full of naturality. As described above, such musical tone is obtained by well-mixing the transient sound and direct sound together in response to the pitch. As described before, the transient sound is produced when the hammer strikes the string, while the direct sound is produced due to the string vibration. Incidentally, it is possible to further employ touch information representative of the touch imparted to the key of the piano. In this case, the transient sound can be emphasized when relatively strong touch is applied to the key, so that it is possible to obtain well-simulated musical tone full of reality.

Incidentally, when starting to generate the musical tone, the coefficient γ1 is set relatively large, while another coefficient γ2 is set relatively small, so that the transient sound is emphasized. Then, γ1 is smoothly decreased but γ2 is smoothly increased in a lapse of time, so that the direct sound corresponding to the string vibration will be gradually emphasized in a lapse of time. By controlling the coefficients γ1, γ2 as described above, it is possible to generate the further-well-simulated musical tone full of naturality.

[B] SECOND EMBODIMENT

Figure 2:
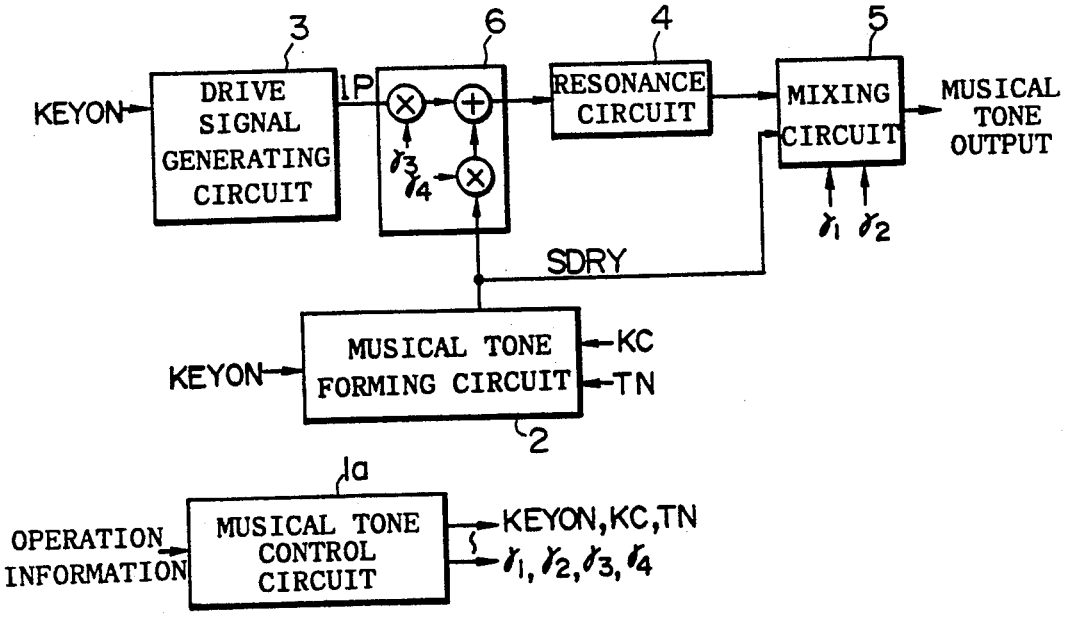
FIG. 2 is a block diagram showing a second embodiment of the present invention.

FIG. 2 is a block diagram showing the musical tone synthesizing apparatus according to the second embodiment which is designed to synthesize the piano sounds. In FIG. 2, the parts corresponding to those shown in FIG. 1 are designated by the same numerals.

In contrast to the foregoing first embodiment, the second embodiment further provides a mixing circuit 6 which is inserted between the drive signal generating circuit 3 and resonance circuit 4 in order to mix the impulse signal IP with the direct sound signal SDRY outputted from the musical tone forming circuit 2. Herein, the mixing circuit 6 is supplied with coefficients γ3, γ4, by which the mixing ratio of the impulse signal IP and direct sound signal SDRY is to be controlled. In the concrete, as similar to the foregoing first embodiment, these coefficients are set such that γ3 becomes large but γ4 becomes small as the pitch becomes higher. In other words, the mixing ratio of the impulse signal IP becomes large as the pitch becomes higher.

According to this musical tone synthesizing apparatus, the resonance circuit 4 can output the signal corresponding to the resonant sound which is obtained when propagating both of the impulse and string vibration toward to the acoustic plate, wherein the impulse is occurred when the hammer strikes the string so that the string vibration occurs. Such output signal of the resonance circuit 4 is mixed with the direct sound signal SDRY in the mixing circuit 5, from which the musical tone output is obtained.

Thus, it is possible to well-simulate the actual musical tone generated from the acoustic musical instrument including the direct sound, resonant sound corresponding to the direct sound and transient sound.

(1) Resonance Circuit

Figure 3:
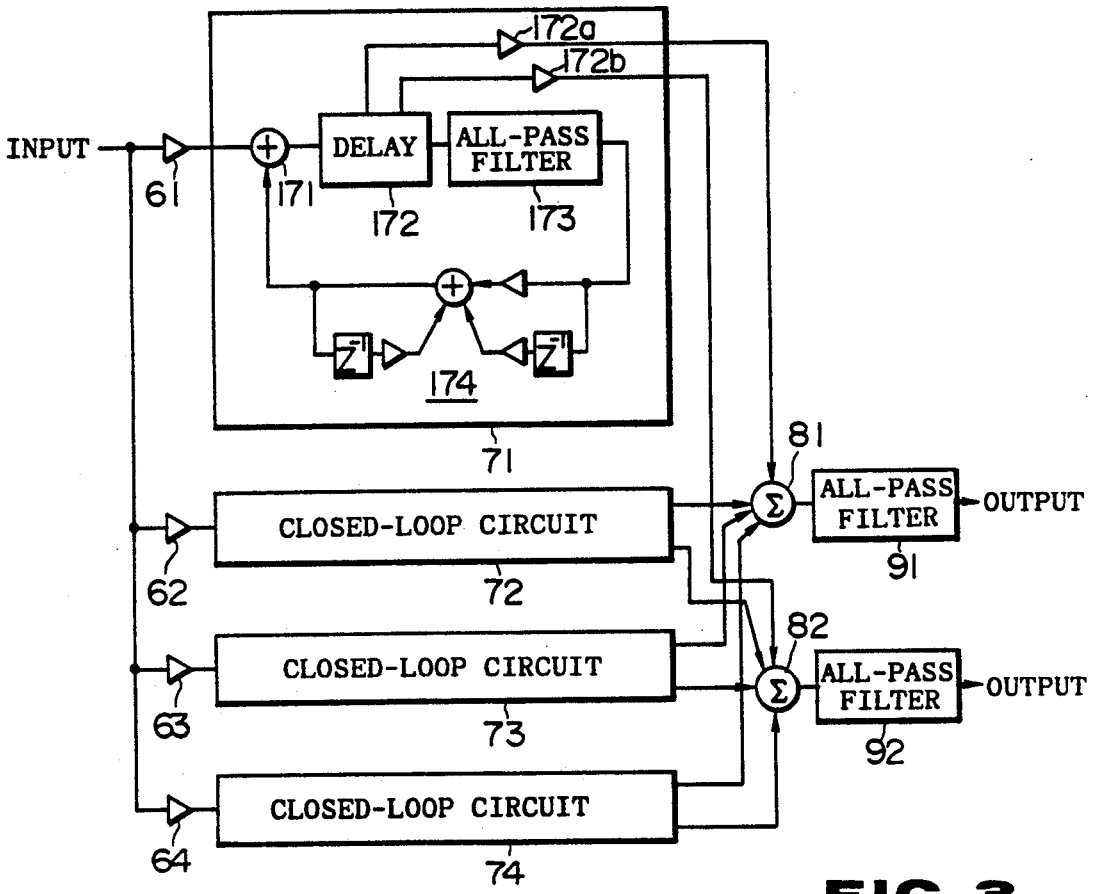
FIG. 3 is a block diagram showing a detailed configuration of the resonance circuit used in first and second embodiments.
Figure 4A:
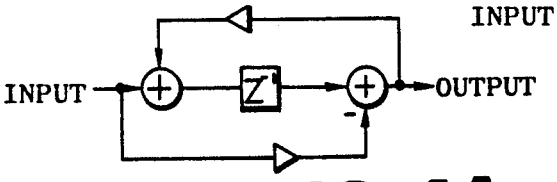
FIGS. 4A to 4D are circuit diagrams each showing an example of all-pass filter used in the resonance circuit shown in FIG. 3.
Figure 4B:
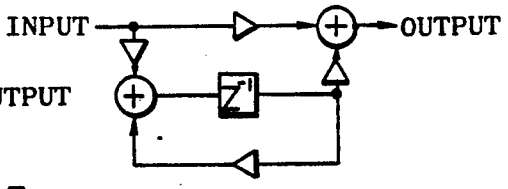
Figure 4C:
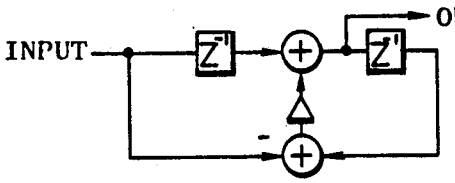
Figure 4D:
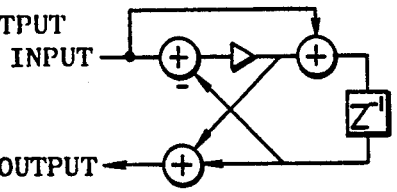

Next, description will be given with respect to the detailed configuration of the resonance circuit 4 which is applied to the first and second embodiments shown in FIGS. 1, 2 by referring to FIG. 3. Herein, FIG. 3 shows an example of stereophonic system which provides both of the left channel output "L" and right channel output "R". However, the first and second embodiments shown in FIGS. 1, 2 are not configured in consideration of such stereophonic system. Thus, one of two channels of this circuit shown in FIG. 3 is used to couple with the first and second embodiments. In some cases, it must be determined whether or not the mixing circuit for mixing the direct sound signal is used with respect to each channel.

Abstractly, this resonance circuit shown in FIG. 3 provides multipliers 61 to 64, closed-loop circuits 71 to 74, adders 81, 82 and all-pass filters 91, 92. Each of the closed-loop circuits 71 to 74 is designed to simulate the resonance characteristic of the acoustic plate of the piano, so that each has the different resonant characteristic. By connecting these closed-loop circuits 71 to 74 in parallel, it is possible to construct the resonance circuit having the whole resonance characteristic corresponding to the sum of four resonance characteristics of the closed-loop circuits 71 to 74.

The closed-loop circuit 71 includes an adder 171, a delay circuit 172, an all-pass filter 173 and well-known low-pass filter 174. Herein, the phase delay of the all-pass filter 173 is designed to be varied in response to the frequency of the input thereof. Thus, the closed-loop circuit 71 can offer the special resonance characteristic having the non-harmonic-overtone-structure in which the resonance frequencies of high degrees are not integral times higher than the primary resonance frequency. When the input signal is supplied to the closed-loop circuit 71 via the multiplier 61, non-harmonic resonance frequency components are extracted from the input signal and then gradually attenuated by the low-pass filter 174 while circulating the closed-loop circuit 71. Incidentally, Japanese Patent Publication No. 56-28274 discloses about the resonance characteristic of the above-mentioned closed-loop circuit using the all-pass filter, for example.

The signal circulating through the closed-loop circuit 71 is picked up at two output terminals each having the different delay time as two delay outputs, which are then supplied to the adders 81, 82 via multipliers 172*a*, 172*b* respectively. Similar to the above-mentioned closed-loop circuit 71, each of the other closed-loop circuits 72 to 74 output a pair of two delay outputs each having the different delay phase, which are then supplied to the adders 81, 82 respectively. Each of the adders 81, 82 adds four delay outputs supplied from four closed-loop circuits 71 to 74 together. Then, addition results of the adders 81, 82 are outputted via the all-pass filters 91, 92 respectively as the left channel output "L" and right channel output "R". As the all-pass filters 173, 91, 92, it is possible to adopt four kinds of the conventionally known circuits as shown in FIGS. 4A to 4D.

According to this resonance circuit shown in FIG. 3, each of the closed-loop circuits 71 to 74 is subject to the resonance state at the different primary resonance frequency, and resonance characteristics of them are not harmonic with each other. Thus, it is possible to well-simulate the resonance characteristic containing a plenty of resonance frequencies corresponding to the resonance operations of the acoustic plate of the piano with accuracy. In addition, a pair of two delay outputs each having the different delay phase are picked up from each closed-loop circuit, and they are outputted as the left channel output "L" and right channel output "R" respectively. Thus, it is possible to impart the reverberation effect to the input signal, by which it is possible to generate the musical tone full of variety.

By applying this resonance circuit shown in FIG. 3 to the first and second embodiments, it is possible to synthesize the well-simulated musical tone which is further close to the actual piano sound.

The above-mentioned embodiments are designed to synthesize the simulated piano sound. However, it is possible to modify these embodiments such that they can synthesize many kinds of the acoustic sounds such as the guitar sounds. In order to synthesize the guitar sound, it is possible to supply another impulse signal to the resonance circuit 4, wherein such another impulse signal represents the impulse applied to the guitar casing to be beaten by the performer. In this case, it is possible to synthesize the transient sounds which are generated when beating the guitar casing in the flamenco guitar performance. In addition, it is possible to synthesize the un-natural sounds which cannot be actually generated from the acoustic musical instrument, such as the sounds synthesized by using the guitar casing as the piano resonator instead of the acoustic plate. Instead of the digital circuits, it is possible to employ analog circuits for the embodiments. Or, it is possible to embody the operations of these embodiments by use of the operational processes to be executed by the digital signal processor (DSP).

(2) Drive Signal Generating Circuit

Figure 5:
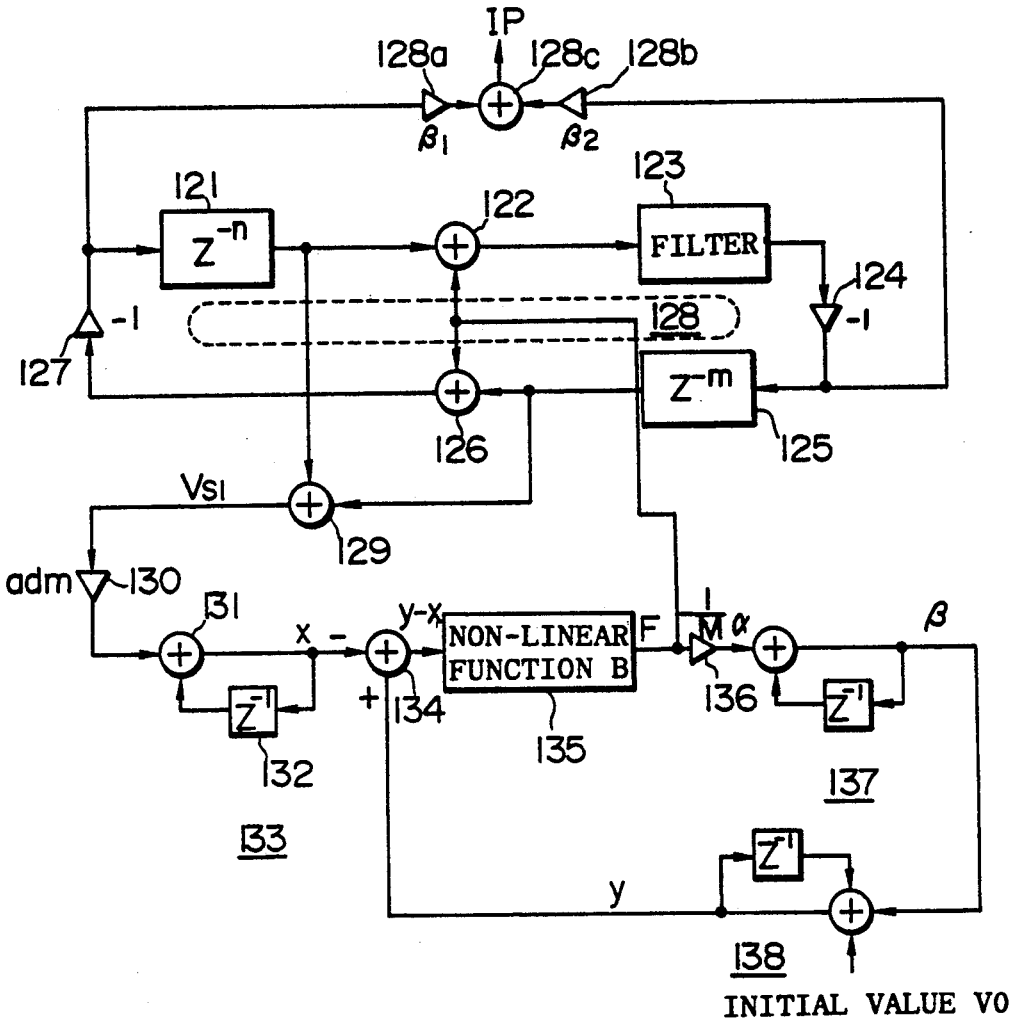
FIG. 5 is a block diagram showing a detailed configuration of a drive signal generating circuit used in first and second embodiments.
Figure 6:
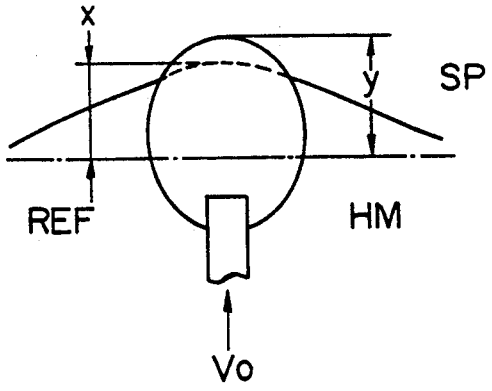
FIG. 6 illustrates a striking manner of the hammer and string of the piano.
Figure 7:
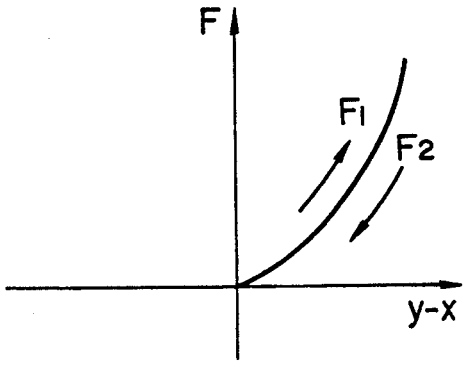
FIG. 7 is a graph showing a curve representing a non-linear function used in the circuit shown in FIG. 5.

Next, description will be given with respect to the detailed configuration of the drive signal generating circuit 3 to be applied to the first and second embodiments by referring to FIGS. 5 to 7.

As described before, this drive signal generating circuit is designed to well-simulate the operations of the hammer and string of the piano. In FIG. 5, a loop circuit 128 is designed to simulate the string operation of the piano, wherein it contains a delay circuit 121, an adder 122, a filter 123, a phase inverter 124, a delay circuit 125, an adder 126 and a phase inverter 127. Herein, the delay circuits 121, 125 simulate the propagation delay of the vibration which propagates through the string; the filter 123 simulates the attenuation of the vibration which propagates through the string; and the phase inverters 124, 127 simulate the phase inversion of the vibration which is occurred at the fixed terminal of the string. In addition, the delay times of the delay circuits 121, 125 are changed over in response to the pitch of the string to be struck by the hammer. Further, the filter coefficient of the filter 123 is also changed over in response to the pitch of the string, so that its band-pass characteristic is to be controlled.

Then, a multiplier 128*a* multiplies the output of phase inverter 127 by a coefficient $\beta 1$, while another multiplier 128*b* multiplies the output of phase inverter 124 by another coefficient $\beta 2$. Thereafter, an adder 128*c* adds multiplication results of these multipliers 128*a*, 128*b* together, so that the addition result thereof is outputted as the impulse signal IP. Herein, the coefficients $\beta 1$, $\beta 2$ are changed over in response to the string to be struck by the hammer. In general, the propagation manner of the vibration which is generated at the string and then propagates toward the acoustic plate is varied in response to the position relationship between each string and acoustic plate of the piano. Thus, by changing over the coefficients $\beta 1$, $\beta 2$ in response to the string to be struck by the hammer, it is possible to generate the impulse signal IP under consideration of the above-mentioned position relationship between each string and acoustic plate of the piano.

The outputs of the delay circuits 121, 125 are added together by an adder 129, which will output a signal $V_{s1}$ corresponding to the string speed. Then, a multiplier 130 multiplies this signal $V_{s1}$ by its coefficient adm, which contents will be described later.

The output of the multiplier 130 is integrated by an integration circuit 133 consisting of an adder 131 and a one-sample-period delay circuit 132. As a result, this integration circuit 133 outputs a signal x representing the displacement of piano string SP from the reference line REF as shown in FIG. 6. Such signal x is supplied to a subtractor 134. In addition, another integration circuit 138, which contents will be described later, outputs another signal y (see FIG. 6) representing the displacement of hammer HM. Then, the subtractor 134 subtracts the signal x from the signal y, so that it outputs the subtraction result "y-x" representing the relative displacement between the hammer HM and string SP. In the case where the hammer HM partially cuts into the string SP, the subtraction result y-x becomes positive. In this case, the impulse force corresponds to y-x effects between the hammer HM and string SP. On the other hand, in the case where the hammer HM slightly touches the string SP or the hammer HM is not in contact with the string SP, y-x is at zero or negative value, so that the impulse force is at zero level. Meanwhile, a ROM 135 memorizes a table of non-linear function B representing the relationship between the relative displacement y-x and impulse force F to be effected between the string SP and hammer HM. FIG. 7 shows a curve representing the non-linear function when the hammer HM is made of flexible materials such as the felt. As shown in FIG. 7, when the hammer HM does not strike the string SP so that the relative displacement y-x is at zero or negative value, the impulse force F is at zero level. On the other hand, when the hammer HM strikes the string SP, the impulse force F gradually increases as the relative displacement y-x increases. Incidentally, in the case where the hammer HM is made of the hard materials, the non-linear function B is set such that the impulse force F rapidly increases responsive to y-x to be increased.

As described above, it is possible to obtain the signal F representing the impulse force which is computed in response to the relative displacement y-x between the hammer HM and string SP. Then, a multiplier 136 multiplies such signal F by a coefficient $-1/M$. Herein, "M" represents the inertial mass of the hammer HM. Thus, the multiplier 136 outputs a signal $\alpha$ corresponding to an acceleration of the hammer HM. This signal $\alpha$ is integrated by an integration circuit 137, from which a signal $\beta$ corresponding to the velocity variation of the hammer HM is to be outputted. Thereafter, the integration circuit 138 receives this signal $\beta$ and a signal Vo corresponding to an initial velocity of the hammer HM. As described before, this integration circuit 138 outputs the signal y corresponding to the displacement of the hammer HM.

Meanwhile, the output signal F of the ROM 135 is applied to the loop circuit 128 as the velocity variation of the string SP which is struck by the hammer HM. In general, the signal F corresponding to the impulse force is multiplied by the coefficient corresponding to the resistance which also corresponds to the velocity variation of the vibration propagates through the string SP so that the velocity variation of the string SP is computed and then applied to the loop circuit 128. Thus, in the circuit shown in FIG. 5, the coefficient adm used by the multiplier 130 corresponds to the above-mentioned resistance.

Next, description will be given with respect to the operation of this drive signal generating circuit shown in FIG. 5. Before striking the string, the hammer HM departs from the string SP so that the relative displacement y-x indicates the negative value. In addition, all of one-sample-period delay circuits contained in the integration circuits 132, 137, 138 are reset at the zero level. When the musical tone generation controlling circuit (not shown) outputs the signal Vo corresponding to the initial velocity of the hammer HM, the integration circuit 138 integrates this signal Vo so that the signal y corresponding to the displacement of the hammer HM varies from negative value to positive value in a lapse of time. In this period, the hammer HM departs from the string SP so that the relative displacement y-x indicates the negative value. In addition, the signal F is initially at zero level as shown in FIG. 7. Therefore, the output $\beta$ of integration circuit 137 is at zero. Thus, the integration circuit 138 merely effects the integration operation on the initial velocity signal Vo, so that integration result y corresponding to the position of the hammer HM varies from negative to positive, which indicates that the hammer HM approaches toward the string SP.

When the hammer HM coincides with the string SP, the relative displacement y-x exceeds over zero level and becomes positive. At this time, the ROM 135 outputs the signal F having the value which corresponds to "y-x". As described before, this signal F is multiplied by the coefficient $-1/M$ by the multiplier 136, which outputs the signal $\alpha$ (having the negative value) corresponding to the acceleration of the hammer HM. By use of this signal $\alpha$, the signal $\beta$ corresponding to the velocity variation of the string SP is to be computed by the integration circuit 137. In this case, the signal $\beta$ is negative so that the integration circuit 138 effects the integration operation such that the initial velocity Vo is decelerated by the signal $\beta$. This means that the increase of the displacement of the hammer HM is slowed down gradually in a lapse of time. In this period, the displacement y of the hammer HM increases in positive direction. In addition, the relative displacement y-x also increases. Thus, as shown by arrow $F_1$ in FIG. 7, the impulse force F which is effected to the hammer HM by the string SP is gradually increased. Therefore, the acceleration $\alpha$ and velocity variation $\beta$ are both increased in negative direction. When the signal $\beta$ exceeds the initial velocity Vo and the velocity direction of the hammer HM is inverted such that the hammer HM departs from the string SP, the increasing direction of the signal y is changed to negative direction. Then, the relative displacement y-x between the hammer HM and string SP is gradually decreased so that the signal F corresponding to the impulse force applied to the hammer HM by the string SP is gradually decreased (see arrow $F_2$). When $y-x<0$, the hammer HM departs from the string SP so that it is released from the restriction of elastic characteristic of the string SP. Then, the striking operation of the hammer HM is completed. As described heretofore, the ROM 135 computes the signal F representing the impulse force of the string SP when the hammer strikes the string, and the signal F is applied to the loop circuit 128. Herein, the signal F represents the velocity element which effects the velocity variation of the string SP by the hammer HM. Such signal F which effects the velocity variation on the string SP is applied to the loop circuit 128 as its excitation signal. This signal is gradually attenuated by the filter 123 while circulating through the loop circuit 128. Based on the outputs of the phase inverters 124, 127 in the loop circuit 128, the impulse signal IP is to be generated.

According to this drive signal generating circuit, it is possible to obtain the impulse signal IP which well-simulates the impulse applied to the string SP by the hammer HM when the hammer strikes the string in the piano. Incidentally, the direct sound signal corresponding to the string vibration can be picked up from the loop circuit 128. Thus, when this drive signal generating circuit shown in FIG. 5 is applied to the foregoing first and second embodiments, the musical tone forming circuit 2 can be omitted.

[C] THIRD EMBODIMENT

Figure 8:
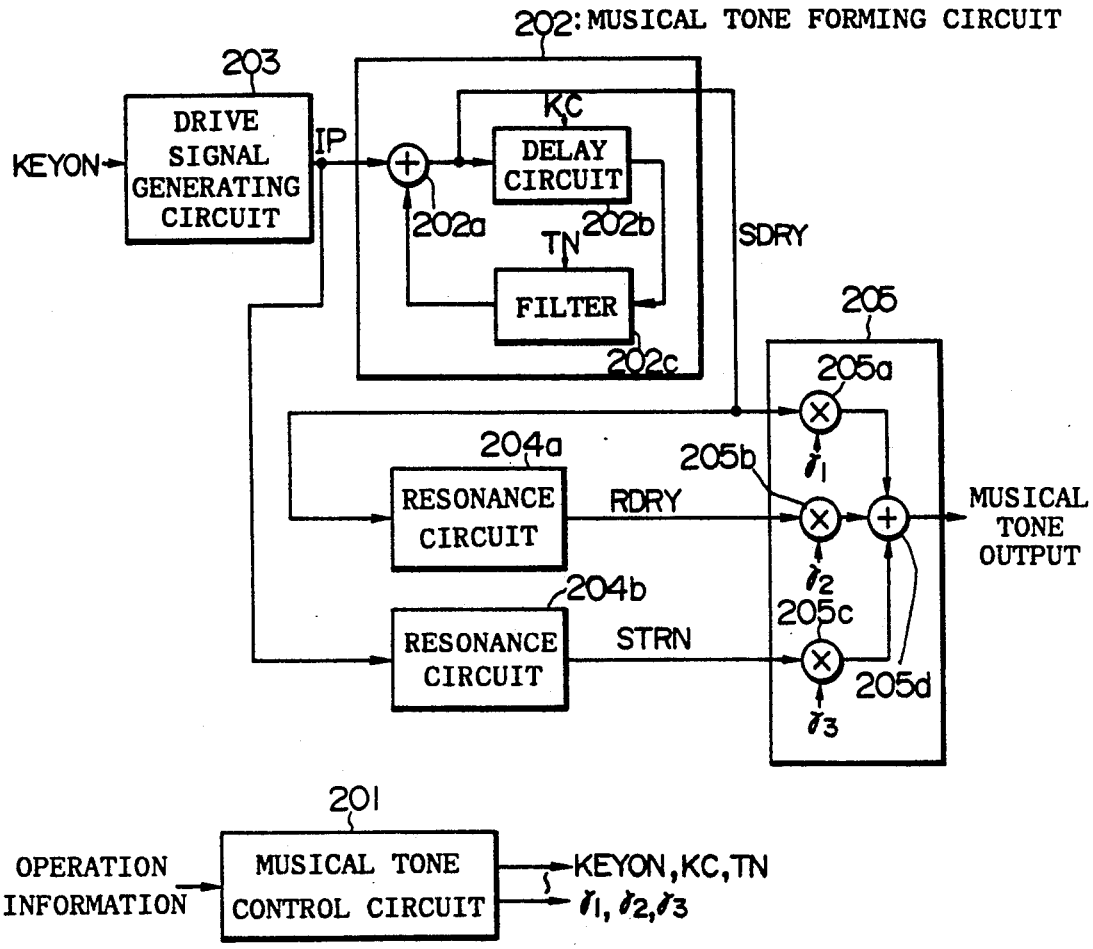
FIG. 8 is a block diagram showing a third embodiment of the present invention.

Next, description will be given with respect to the third embodiment of the present invention by referring to FIG. 8.

As similar to the foregoing musical tone control circuits, a musical tone control circuit 201 generates the signals KEYON, KC, TN and coefficients $\gamma 1$, $\gamma 2$, $\gamma 3$ based on the operation information. In addition, a musical tone forming circuit 202 is designed to form the direct sound corresponding to the operation information. This circuit 202 is embodied by a closed-loop circuit consisting of an adder 202*a*, a delay circuit 202*b* simulating the propagation delay of the vibration which propagates through the string and a filter 202*c* simulating the acoustic loss of the string.

Further, a drive signal generating circuit 203 contains a waveform ROM. By effecting the PCM operation on the impulse waveforms (including a plenty of frequency components) representing the impulses to be occurred when the hammer strikes the string, it is possible to obtain the time-series digital signals representing such impulses, which are memorized in the waveform ROM.

In response to the key-on signal KEYON which is generated from the musical tone control circuit 201 when the musical tone is to be generated, the above-mentioned digital signals are sequentially read from the waveform ROM, and they are supplied to the musical tone forming circuit 202 and resonance circuit 204 as the impulse signal IP.

In the musical tone forming circuit 202, the impulse signal IP circulates through the closed-loop consisting of the adder 202*a*, delay circuit 202*b* and filter 202*c* as the drive signal. This closed-loop functions as the resonance circuit having the primary resonance frequency and its higher harmonic frequencies, wherein the primary resonance frequency corresponds to the inverse value of the delay time which is required when such drive signal circulates through the closed-loop once. By circulating through the closed-loop, each of the resonance frequency components in the drive signal is emphasized.

For example, the delay circuit 202*b* can be embodied by the shift register of which number of stages can be arbitrarily changed over. In this case, the delay time of this delay circuit 202*b* is changed over by the key code information KC outputted from the musical tone control circuit 201. Thus, it is possible to change over the period to be required when the excitation signal circulates through the closed-loop once, i.e., the primary resonance frequency of the musical tone by each string. The filter 202*c* can be embodied by use of the low-pass filter. Since each string has different frequency characteristic of the attenuation rate of vibration, a tone color parameter TN corresponding to each string is supplied to the filter 202*c* from the musical tone control circuit. In accordance with such tone color parameter TN, the filtering coefficient of the filter 202*c* is changed over. Thus, the musical tone forming circuit 202 forms the direct sound signal SDRY having the pitch and tone color designated by the musical tone control circuit 201. Incidentally, it is possible to configure the musical tone forming circuit 202 by use of the FM sound source or PCM sound source, for example.

Each of the resonance circuits 204*a*, 204*b* is designed as the circuit which carries out the signal processing corresponding to the resonating operation of the acoustic plate of the piano. For example, it is possible to configure such resonance circuit by the closed-loop including the delay circuit and filter as similar to the foregoing musical tone forming circuit 202. The resonance circuit 204*a* applies the resonance effect to the direct sound signal SDRY to thereby generate the resonant sound signal RDRY corresponding to the standing-wave signal of the string. On the other hand, the resonance circuit 204*b* applies the resonance effect to the impulse signal IP to thereby generate the transient sound signal STRN corresponding to the resonant sound which is produced in response to the impulse to be applied to the string by the hammer.

Next, a mixing circuit 205 includes multipliers 205*a*, 205*b*, 205*c* and an adder 205*d*. The multiplier 205*a* multiplies the direct sound signal SDRY by the coefficient $\gamma 1$ which is supplied thereto from the musical tone control circuit 201. In addition, the multiplier 205*b* multiplies the resonant sound signal RDRY by the coefficient $\gamma 2$, while the multiplier 205*c* multiplies the transient sound signal STRN by the coefficient $\gamma 3$. Then, all of the multiplication results of the multipliers 205*a*, 205*b*, 205*c* are added together by the adder 205*d*, of which addition result is outputted as the musical tone signal.

Next, description will be given with respect to the operation of the third embodiment which is coupled with the keyboard unit so as to assemble the electronic musical instrument. When the key operation of the keyboard unit is detected, the musical tone control circuit 201 outputs the tone color parameter TN and key code information KC which is used to designate the pitch. In accordance with these outputs to be supplied to the musical tone forming circuit 202, the delay time of delay circuit 202*b* and the filtering coefficient of filter 202*c* are to be set. When the musical tone control circuit 201 outputs the key-on signal KEYON, the drive signal generating circuit 203 is driven so that the musical tone forming circuit 202 generates the direct sound signal SDRY.

In response to the direct sound signal SDRY, the resonance circuit 204*a* generates the resonant sound signal RDRY. In response to the impulse signal IP, the resonance circuit 204*b* generates the transient sound signal STRN. These signals SDRY, RDRY, STRN are mixed together by the mixing circuit 205 so as to produce the musical tone signal.

In the third embodiment, the coefficient $\gamma 3$ used by the multiplier 205 is set as follows.

In case of the piano, as the pitch becomes higher, the transient sound is more emphasized. Thus, the coefficient $\gamma 3$ is set to be larger as the pitch becomes higher.

Thus, it is possible to generate the musical tone full of naturality, because the transient sound to be produced when the hammer strikes the string is well-mixed into the musical tone in response to the pitch. In addition, it is possible to modify the third embodiment such that transient sound is more emphasized as the touch intensity applied to the piano key becomes stronger by use of the touch information. In this case, it is possible to generate the further realistic musical tone.

Incidentally, the coefficient $\gamma 3$ can be set larger at the initial stage of the tone-generation, and then it is reduced to smaller value in a lapse of time. In this case, the transient sound is emphasized at the initial stage of the tone-generation, and then it is gradually attenuated. Thus, it is possible to generate the furthermore realistic musical tone.

[D] FOURTH EMBODIMENT

Next, description will be given with respect to the fourth embodiment of the present invention by referring to FIG. 9.

Figure 9:
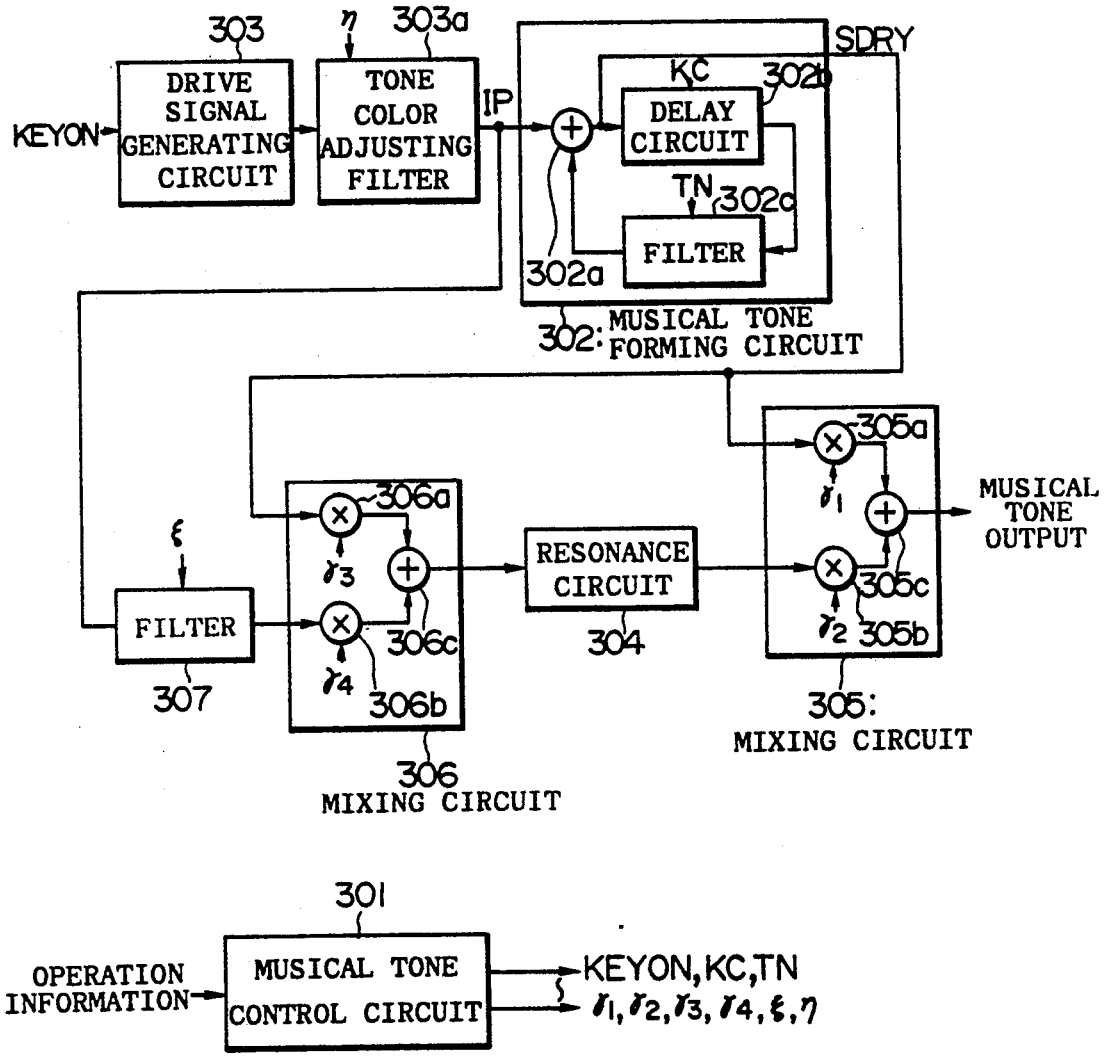
FIG. 9 is a block diagram showing a fourth embodiment of the present invention.

In FIG. 9, a musical tone control circuit 301 generates several kinds of control information in response to the operation information applied thereto from the external device (not shown), while a musical tone forming circuit 302 which is designed to form the direct sound is configured by a closed-loop consisting of an adder 302*a*, a delay circuit 302*b* and a filter 302*c*.

In addition, a drive signal generating circuit 303 provides a waveform ROM which memorizes the digital signals representative of the impulse waveforms and the like. When the musical tone control circuit 301 supplies the key-on signal KEYON to the drive signal generating circuit 303, the digital signals are sequentially read from the waveform ROM, passes through a tone color adjusting filter 303*a* and then outputted as the impulse signal IP, which will be supplied to both of the musical tone forming circuit 302 and a filter 307. Herein, the tone color adjusting filter 303*a* is provided in order to adjust the waveform of the impulse signal IP in response to the sound intensity. In response to control information $\eta$ outputted from the musical tone control circuit 301, the filtering coefficient of this filter 303*a* is to be changed over.

As similar to the foregoing musical tone forming circuits, this musical tone forming circuit 302 functions as the resonance circuit having the primary resonance frequency and its higher harmonic frequencies, wherein the primary resonance frequency corresponds to the inverse value of the delay time to be required when the drive signal circulates through the closed-loop of the musical tone forming circuit 302 once. Every time the drive signal circulates through the closed-loop, each of the resonance frequency components thereof is emphasized.

The filter 307 simulates the propagation loss of the vibration which propagates from the fixed terminal of string toward the acoustic plate. This filter 307 restricts the frequency band of the impulse signal IP. In general, as the frequency becomes higher, the above-mentioned propagation loss becomes larger. Therefore, this filter 307 is designed as the low-pass filter. In addition, the filtering coefficient of the filter 307 is changed over by each string in response to control information $\xi$ outputted from the musical tone control circuit 301.

Meanwhile, a mixing circuit 306 includes multipliers 306*a*, 306*b* and an adder 306*c*. Herein, the multiplier 306*a* multiplies the direct sound signal SDRY by the coefficient $\gamma 3$, while the multiplier 306*b* multiplies the output of filter 307 by the coefficient $\gamma 4$. Then, the adder 306*c* adds the multiplication results of the multipliers 306*a*, 306*b* together. The addition result of adder 306*c* is supplied to a resonance circuit 304. The ratio between the coefficients $\gamma 3$, $\gamma 4$ are controlled in response to the pitch. Incidentally, the fourth embodiment provides a volume control (not shown) which adjusts the tone volume of the transient sound. By operating this volume control, it is possible to change over the coefficients $\gamma 3$, $\gamma 4$.

The resonance circuit 304 simulates the acoustic characteristic of the acoustic plate of the piano as similar to the foregoing resonance circuits. This resonance circuit 304 applies the resonance effect to the output of the mixing circuit 306. As a result, this resonance circuit 304 can produce the resonant sound corresponding to the standing-wave vibration of string and the impulse which is applied to the string by the hammer.

Next, a mixing circuit 305 includes multipliers 305*a*, 305*b* and an adder 305*c*. Herein, the multiplier 305*a* multiplies the direct sound signal SDRY by the coefficient $\gamma 1$, while the multiplier 305*b* multiplies the output of resonance circuit 304 by the coefficient $\gamma 2$. Then, the adder 305*c* adds both of the multiplication results of the multipliers 305*a*, 305*b* together. These coefficients $\gamma 1$, $\gamma 2$ are set at the values suitable for the musical tone to be generated. However, it is possible to change over these coefficients by operating the volume control (not shown) which is used to control the tone volume of the direct sound. Thus, the mixing circuit 305 mixes the direct sound signal SDRY and output of resonance circuit 304 together so as to produce the musical tone signal.

In order to well-simulate the piano in which the transient sound is more emphasized as the pitch becomes higher, the coefficients used in the mixing circuit 306 are controlled such that $\gamma 4$ becomes larger with respect to $\gamma 3$ as the pitch becomes higher. Incidentally, it is possible to adjust the ratio between $\gamma 3$, $\gamma 4$ in response to the touch intensity applied to the key. Or, it is possible to smoothly vary such ratio in a lapse of time.

[E] FIFTH EMBODIMENT

Figure 10:
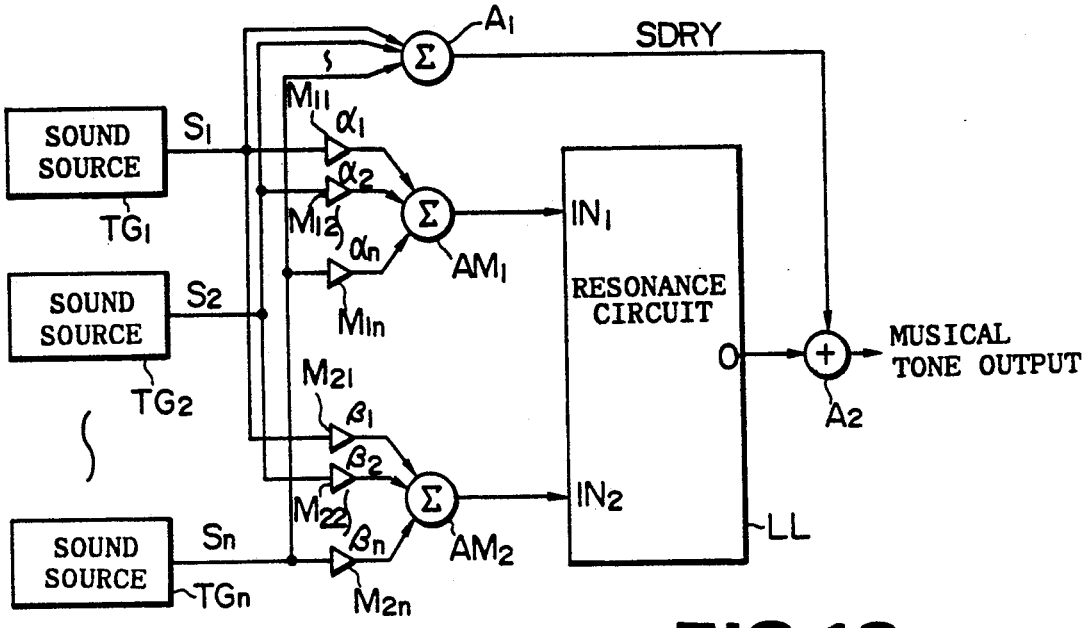
FIG. 10 is a block diagram showing a fifth embodiment of the present invention.

Next, description will be given with respect to the fifth embodiment of the present invention by referring to FIG. 10. This fifth embodiment is designed to carry out the acoustic processing corresponding to the function of the acoustic plate of the piano. In FIG. 10, sound sources $TG_1$ to $TG_n$ respectively correspond to n strings of the piano each having the different pitch. These sound sources $TG_1$ to $TG_n$ are driven by performance control means (not shown) based on the performance information. When each string is excited, each sound source forms the corresponding musical tone waveform. Thus, the sound sources $TG_1$ to $TG_n$ outputs the musical tone waveforms as musical tone signals $S_1$ to $S_n$, which are added together by an adder $A_1$. Then, the addition result of this adder $A_1$ is outputted to an adder $A_2$ as the direct sound signal SDRY.

In addition, the musical tone signals $S_1$ to $S_n$ are respectively multiplied by coefficients $\alpha 1$ to $\alpha n$ in multipliers $M_{11}$ to $M_{1n}$. Then, multiplication results of these multipliers $M_{11}$ to $M_{1n}$ are added together by an adder $AM_1$, of which addition result is supplied to an input terminal $IN_1$ of a resonance circuit LL. Further, the musical tone signals $S_1$ to $S_n$ are respectively multiplied by coefficients $\beta 1$ to $\beta n$ in multipliers $M_{21}$ to $M_{2n}$. Then, multiplication results of these multipliers $M_{21}$ to $M_{2n}$ are added together by an adder $AM_2$, of which addition result is supplied to an input terminal $IN_2$ of the resonance circuit LL. Herein, each coefficient $\alpha k$ (where $k=1$ to n) represents the rate by which the musical tone signal $S_k$ belongs to the higher pitch range. As the pitch of the musical tone signal $S_k$ becomes higher, such coefficient $\alpha k$ is set larger. On the other hand, the coefficient $\beta k$ (where $k=1$ to n) represents the rate by which the musical tone signal $S_k$ belongs to the lower pitch range. As the pitch of the musical tone signal $S_k$ becomes higher, this coefficient $\beta k$ is set smaller. Thus, the musical tone signal $S_k$ are divided into two components in accordance with the above-mentioned rates corresponding to the pitch, and two components are respectively delivered to the input terminals $IN_1$, $IN_2$ of the resonance circuit LL.

The resonance circuit LL is provided in order to simulate the acoustic characteristic of the acoustic plate of the piano, wherein each pitch corresponds to the different acoustic characteristic. More specifically, the resonance circuit LL has two acoustic processing functions for the higher pitch range and lower pitch range respectively. The first component of the musical tone signal $S_k$ delivered to the input terminal $IN_1$ is subject to the first acoustic processing for higher pitch range, while second component of $S_k$ is subject to second acoustic processing for lower pitch range. Then, the results of two acoustic processings are mixed together so as to produce the resonant sound signal with respect to each musical tone signal $S_k$. As described before, the musical tone signal $S_k$ is distributed to the input terminals $IN_1$, $IN_2$ in accordance with the pitch-corresponding-rate. As a result, the pitch-corresponding acoustic processing can be carried out on each musical tone signal $S_k$. Thereafter, the resonant sound signal outputted from the resonance circuit LL is added to the direct sound signal SDRY outputted from the adder $A_1$ in an adder $A_2$, from which the natural musical tone to be produced from the acoustic musical instrument can be obtained.

[F] SIXTH EMBODIMENT

Figure 11:
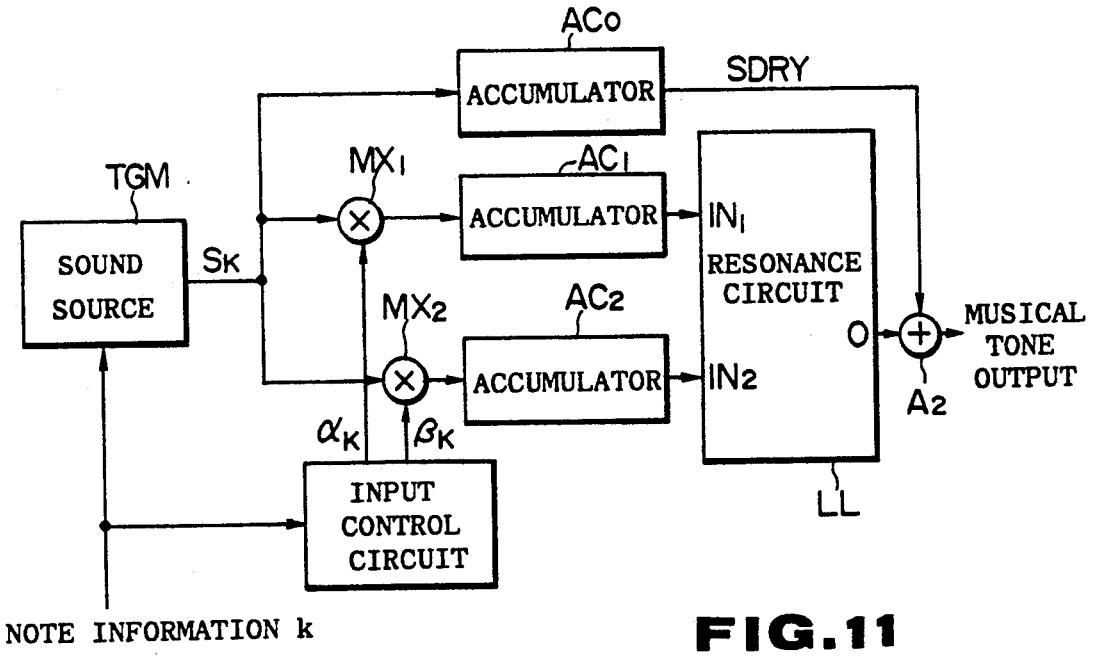
FIG. 11 is a block diagram showing a sixth embodiment of the present invention.

In the electronic musical instrument, the constant period of the sound source which carries out the time-series processing is divided into plural time slots. In this case, each of several kinds of musical tones is formed by each time slot. FIG. 11 shows the sixth embodiment of the present invention using a sound source TGM which carries out the time-series processing. In FIG. 11, parts identical to those shown in FIG. 10 will be designated by the same numerals.

The sound source TGM is configured to form the foregoing musical tone signals $S_1$ to $S_n$. The constant period of the sound source TGM is divided into n time slots. Thus, each of the musical tone signals $S_1$ to $S_n$ is formed in each time slot. In response to note information k which is generated when the performance member is operated, the musical tone signal $S_k$ is formed and then outputted in the corresponding time slot. This musical tone signal $S_k$ is supplied to an accumulator $AC_0$ and multipliers $MX_1$, $MX_2$.

The accumulator $AC_0$ accumulates all of the musical tone signals which are outputted from the sound source TGM within the above-mentioned constant period. Then, the accumulated musical tone signal is supplied to the adder $A_2$ as the direct sound signal SDRY.

Next, an input control circuit CONT generates coefficients $\alpha k$, $\beta k$ corresponding to the musical tone signal $S_k$ at the timing synchronizing with the musical tone signal $S_k$ which is outputted based on the note information k. Then, a multiplier $MX_1$ multiplies the musical tone signal $S_k$ by the coefficient $\alpha k$, so that the multiplication result thereof is to be accumulated by an accumulator $AC_1$. On the other hand, a multiplier $MX_2$ multiplies the musical tone signal $S_k$ by the coefficient $\beta k$, so that the multiplication result thereof is to be accumulated by an accumulator $AC_2$. As described above, the musical tone signal $S_k$ is divided into two components, which are distributed to and then accumulated in the accumulators $AC_1$, $AC_2$ respectively by the distribution rate corresponding to the pitch. The outputs of the accumulators $AC_1$, $AC_2$ are supplied respectively to the input terminals $IN_1$, $IN_2$ of the resonance circuit LL. As described before in the fifth embodiment shown in FIG. 10, the resonance circuit LL carries out the acoustic processings on the musical tone signal $S_k$ in response to the pitch.

[G] SEVENTH EMBODIMENT

Figure 12:
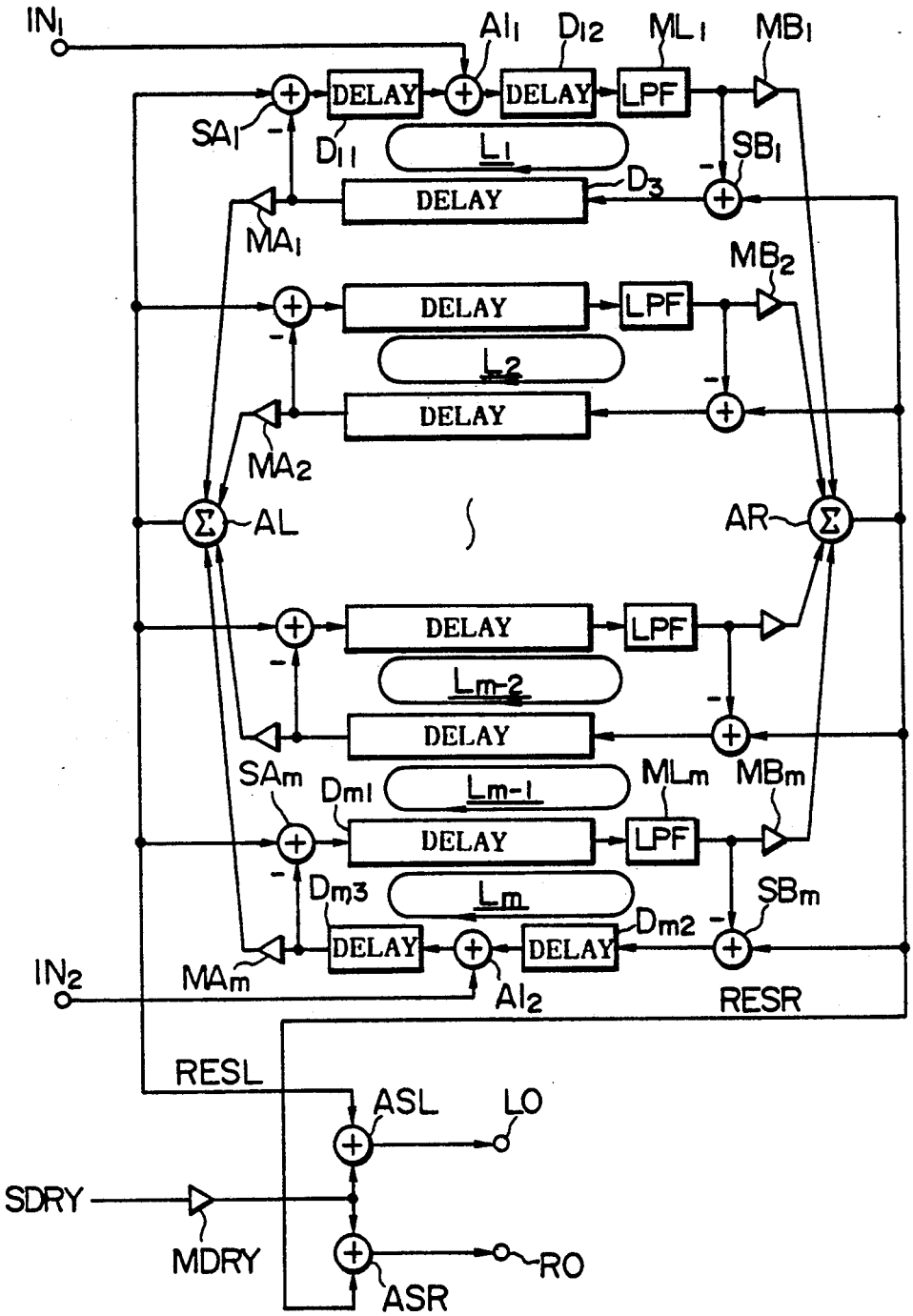
FIG. 12 is a block diagram showing a seventh embodiment of the present invention.

FIG. 12 is a block diagram showing the seventh embodiment of the present invention. More specifically, FIG. 12 shows the circuit portion corresponding to the foregoing resonance circuit LL as shown in FIGS. 10, 11. However, FIG. 12 does not show the circuit portion in which the direct sound signal SDRY is generated and another circuit portion in which the musical tone signal outputted from the sound source is distributed to the resonance circuit LL, because these circuit portions as shown in FIGS. 10, 11 can be directly applied to the seventh embodiment. Different from the foregoing fifth and sixth embodiments, the seventh embodiment provides adders ASL, ASR which mixes the output of resonance circuit LL to the direct sound signal SDRY and then outputs the mixed signal as the left and right channel outputs LO, RO.

A loop circuit $L_1$ includes delay circuits $D_{11}$ to $D_{13}$, a low-pass filter $ML_1$, subtractors $SA_1$, $SB_1$ and an adder $AI_1$. Herein, the adder $AI_1$ is used to introduce the musical tone signal applied to the input terminal $IN_1$ into the loop circuit $L_1$. Similarly, a loop circuit $L_m$ includes delay circuits $D_{m1}$ to $D_{m3}$, a low-pass filter $ML_m$, subtractors $SA_m$, $SB_m$ and an adder $AI_2$ which is used to introduce the musical tone signal applied to the input terminal $IN_2$ therein. The input terminals $IN_1$, $IN_2$ shown in FIG. 12 are respectively supplied with foregoing two components of the musical tone signal in advance. As similar to the above-mentioned loop circuits $L_1$, $L_m$ (except for the adders $AI_1$, $AI_2$), other loop circuits $L_2$ to $L_{m-1}$ are configured by the delay circuits, low-pass filter and the like. Herein, the loop circuits $L_1$ to $L_m$ are configured such that the input signal circulates through each loop circuit, by which each loop circuit is subject to the resonance state. Each loop circuit has the different delay time which is required when the signal circulates through the loop circuit once. In other words, the loop circuits function as the resonance circuits each having the different resonance frequency. Further, the low-pass filters $ML_1$ to $ML_m$ attenuate the signal circulating the loop circuit.

In the loop circuit $L_1$, the output of delay circuit $D_{13}$ is supplied to the subtractor $SA_1$ and also multiplied by the predetermined attenuation coefficient in the multiplier $MA_1$. Then, the multiplication result of multiplier $MA_1$ is supplied to an adder AL. On the other hand, the output of low-pass filter $ML_1$ is supplied to the subtractor $SB_1$ and also multiplied by the predetermined attenuation coefficient in the multiplier $MB_1$. Then, the multiplication result of multiplier $MB_1$ is supplied to an adder AR. Similar to the above-mentioned loop circuit $L_1$, two signals are respectively picked up from two points of each of the other loop circuits $L_1$ to $L_m$, and they are attenuated and then supplied to the adders AL, AR respectively. The addition result of the adder AL is fed back to the subtractors $SA_1$ to $SA_m$ in the loop circuits $L_1$ to $L_m$, while the addition result of the adder AR is fed back to the subtractors $SB_1$ to $SB_m$ in the loop circuits $L_1$ to $L_m$.

In addition, the output of adder AL is supplied to an adder ASL as a left-channel resonant sound signal RESL, while the output of adder AR is supplied to an adder ASR as a right-channel resonant sound signal RESR. The foregoing direct sound signal SDRY is multiplied by the predetermined coefficient in a multiplier MDRY. Then, the multiplication result of multiplier MDRY is delivered to both of the adders ASL, ASR. The addition result of adder ASL is outputted via the left-channel output LO, while the addition result of adder ASR is outputted via the right-channel output RO.

Next, description will be given with respect to the operation of the present invention shown in FIG. 12. When the signal is supplied to the adder $AI_1$ via the input terminal $IN_1$, this signal circulates through the loop circuit $L_1$ while being gradually attenuated by the low-pass filter $ML_1$ so that the loop circuit $L_1$ remains at the resonant state. Thus, the continuity can be imparted to the musical tone.

The output of delay circuit $D_{13}$ is attenuated by the multiplier $MA_1$, passed through the adder AL and then supplied to the subtractors $SA_1$ to $SA_m$ in the loop circuits $L_1$ to $L_m$. On the other hand, the output of low-pass filter $ML_1$ is attenuated by the multiplier $MB_1$, passed through the adder AR and then supplied to the subtractors $SB_1$ to $SB_m$ in the loop circuits $L_1$ to $L_m$. As a result, in addition to the loop circuit $L_1$, other loop circuits $L_1$ to $L_m$ are also set in the resonant state. Then, the signals respectively circulating through the loop circuits $L_1$ to $L_m$ are picked up and then added together by the adders AL, AR. The outputs of the adders AL, AR are fed back to the loop circuits $L_1$ to $L_m$. The above-mentioned operation is repeatedly performed. Thus, the circuit shown in FIG. 12 functions as one resonance circuit having all of the resonance frequencies of the loop circuits $L_1$ to $L_m$, so that certain resonance effect is imparted to the input signal applied to the input terminal $IN_1$.

In the circuit shown in FIG. 12, the input signal applied to the input terminal $IN_1$ is directly supplied to the loop circuit $L_1$, however, it is attenuated by the loop circuit $L_1$ and then indirectly supplied to the other loop circuits $L_1$ to $L_m$. Therefore, the resonance frequency characteristic of the loop circuit $L_1$ must be the strongest as compared to that of the other loop circuits $L_2$ to $L_m$. Thus, the input signal is strongly effected by such resonance frequency characteristic of the loop circuit $L_1$.

In contrast, another input signal applied to the input terminal $IN_2$ is subject to the resonance operation in the loop circuit $L_m$ at first. Then, the other loop circuits $L_1$ to $L_{m-1}$ performs the resonance operation on the output of the loop circuit $L_m$. Therefore, this input signal is strongly effected by the resonance frequency characteristic of the loop circuit $L_m$.

When two input signals are respectively supplied to the input terminals $IN_1$, $IN_2$, the loop circuits $L_1$ to $L_m$ perform respective resonance operations on two input signals. Then, the adders AL, AR output the signals each of which is obtained by mixing two resonant sound signals respectively corresponding to the two input signals applied to the input terminals $IN_1$, $IN_2$. Thereafter, the output of adder AL is supplied to the adder ASL as the left-channel resonant sound signal RESL, which is added to the multiplication result of multiplier MDRY and then outputted via the output terminal LO. On the other hand, the output of adder AR is supplied to the adder ASR as the right-channel resonant sound signal RESR, which is added to the multiplication result of multiplier MDRY and then outputted via the output terminal RO.

As described heretofore, the input signal of the input terminals $IN_1$, $IN_2$ are imparted with the different resonant effects. Then, two resonant sound signals are mixed together. Herein, the musical tone signal is divided into two components, which are distributed to the input terminals $IN_1$, $IN_2$ by the distribution rate corresponding to the pitch. Thus, it is possible to impart the resonance effect to the musical tone signal in response to its pitch.

[H] EIGHTH EMBODIMENT

Figure 13:
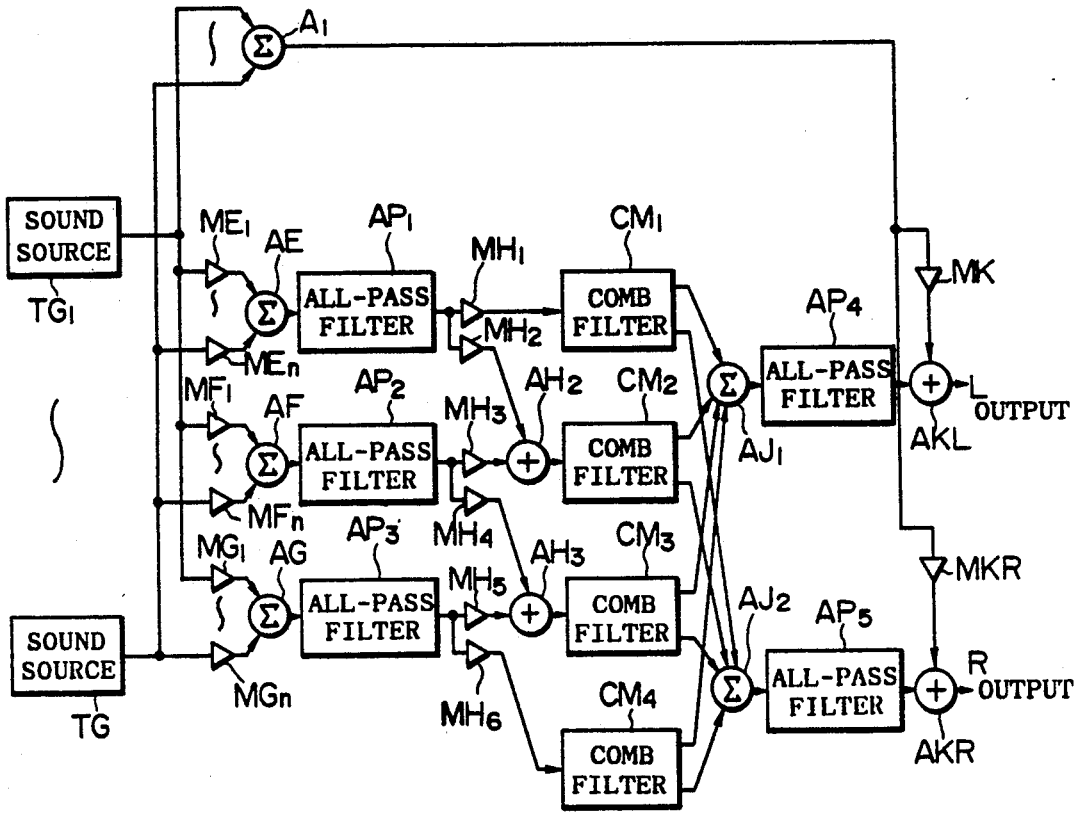
FIG. 13 is a block diagram showing an eighth embodiment of the present invention.
Figure 14:
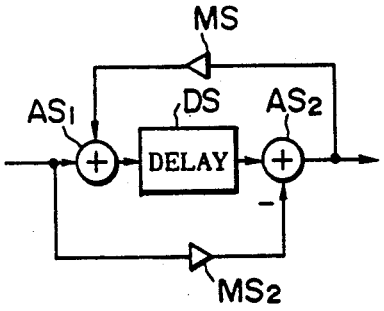
FIGS. 14 and 15 are circuit diagrams showing detailed configurations of an all-pass filter and a comb filter shown in FIG. 13.

Finally, description will be given with respect to the eighth embodiment of the present invention by referring to FIGS. 13 to 15. In FIG. 13, parts identical to those of the foregoing fifth embodiment shown in FIG. 10 are designated by the same numerals, hence, description thereof will be omitted.

As similar to the foregoing fifth embodiment, the musical tone signals generated from the sound sources $TG_k$ (where k=1 to n) are added together by the adder $A_1$, which addition result is delivered to multipliers MKL, MKR as the direct sound signal SDRY. In addition, the musical tone signals are distributed to adders AE, AF, AG by multipliers $ME_k$, $MF_k$, $MG_k$ (where k=1 to n). The outputs of the adders AE, AF, AG are respectively supplied to all-pass filters $AP_1$, $AP_2$, $AP_3$. FIG. 14 illustrates an example of the primary all-pass filter, which is configured by multipliers $MS_1$, $MS_2$, an adder $AS_1$, a subtractor $AS_2$ and a delay circuit DS. As known well, this kind of all-pass filter has the characteristic in which its phase delay is varied by the signal frequency. Thus, each of the outputs of adders AE, AF, AG is delayed by each of the all-pass filters $AP_1$, $AP_2$, $AP_3$ wherein each frequency component is delayed by the different delay time. Due to the operation of the all-pass filter, the musical tone signal is delayed from its tone-generation timing in response to its pitch. Incidentally, other all-pass filters $AP_4$, $AP_5$ are configured as similar to the above-mentioned all-pass filters $AP_1$ to $AP_3$.

The output of all-pass filter $AP_1$ is divided into two components by multipliers $MH_1$, $MH_2$, which are then distributed to a comb filter $CM_1$ and an adder $AH_2$ respectively. Similarly, the output of all-pass filter $AP_2$ is divided into two components by multipliers $MH_3$, $MH_4$, which are then distributed to adders $AH_2$, $AH_3$ respectively, while the output of all-pass filter $AP_3$ is divided into two components by multipliers $MH_5$, $MH_6$, which are then distributed to the adder $AH_3$ and a comb filter $CM_4$ respectively. The multiplication results of the multipliers $MH_2$, $MH_3$ are added together by the adder $AH_2$, which addition result is supplied to a comb filter $CM_2$. Similarly, the multiplication results of the multipliers $MH_4$, $MH_5$ are added together by the adder $AH_3$, which addition result is supplied to a comb filter $CM_3$.

Figure 15:
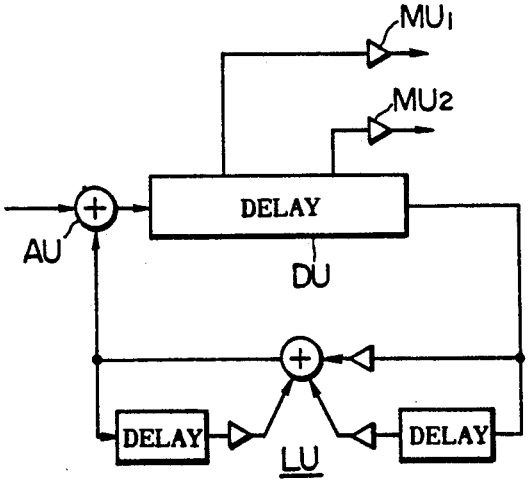

FIG. 15 illustrates an example of the comb filter, which is configured by a closed-loop consisting of an adder AU, a delay circuit DU and a low-pass filter LU. Such comb filter has the multi-peak resonance frequency characteristic including the primary resonance frequency and its higher harmonic frequencies, wherein the primary resonance frequency corresponds to the inverse value of the delay time of the above-mentioned closed-loop. In addition, the attenuation characteristic of the signal circulating through the closed-loop depends on the band-pass characteristic of the low-pass filter LU. As shown in FIG. 15, two signals are picked up from the delay circuit DU, wherein each signal is delayed by the different delay time. These two signals are multiplied by the predetermined coefficients in multipliers $MU_1$, $MU_2$, which multiplication results are picked up as two outputs of the comb filter. First outputs of the comb filters $CM_1$ to $CM_4$ are added together by an adder $AJ_1$, which addition result is passed through the all-pass filter $AP_4$ and then supplied to an adder AKL. The adder AKL adds the output of all-pass filter $AP_4$ and output of a multiplier MKL together to thereby form and output the left-channel musical tone signal. On the other hand, second outputs of the comb filters $CM_1$ to $CM_4$ are added together by an adder $AJ_2$, which addition result is passed through the all-pass filter $AP_5$ and then supplied to an adder AKR. The adder AKR adds the outputs of the all-pass filter $AP_5$ and multiplier MKR together to thereby form and output the right-channel musical tone signal. As described heretofore, each of the left and right channels outputs the musical tone signal having the different delay phase. Thus, it is possible to generate the musical tone full of reality with the reverberation.

According to the present apparatus, the musical tone signals outputted from the sound sources $TG_k$ (where k=1 to n) are distributed into three components by the predetermined distribution rate. Then, these three components are subject to the different filtering processes by the all-pass filters $AP_1$ to $AP_3$ and their circuits. Thereafter, the filtering results are mixed together and then added with the direct sound signal so as to form the left-channel and right-channel musical tone signals. Herein, the higher-pitch range, middle-pitch range and lower-pitch range of the musical tone signal generated from the sound source $TG_k$ can be respectively controlled by adjusting the coefficients of the multipliers $ME_k$, $MF_k$, $MG_k$. In other words, it is possible to vary the contents of the filtering operations in response to the pitch of the musical tone signal. Thus, it is possible to reproduce the acoustic characteristic of the resonator of the non-electronic musical instrument with high fidelity.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:
(a) musical tone control means for generating performance information;
(b) musical tone drive signal generating means, connected to receive performance information from the musical tone control means, for generating a drive signal in accordance with said performance information;
(c) musical tone forming means, connected to receive performance information from the musical tone control means, for forming a musical tone signal in response to said performance information;
(d) first resonance means for imparting a resonance effect to said musical tone signal to thereby produce a first resonant sound signal;
(e) second resonance means for imparting a resonance effect to said drive signal to thereby produce a second resonant sound signal; and
(f) mixing means for mixing said musical tone signal, said first resonant sound signal and said second resonant sound signal together in accordance with said performance information,
wherein an output of said mixing means is picked up as a synthesized musical tone signal.

2. A musical tone synthesizing apparatus in accordance with claim 1 wherein said musical tone drive signal generating means is a loop circuit comprising:
nonlinear function generating means for receiving an input signal which is a function of performance information and generating an output signal having nonlinear input versus output characteristics; and
a signal path forming a loop and including means for introducing the output signal to the signal path and delay means for delaying a signal on the path by a predetermined delay interval, which delay interval determines the pitch of the musical tone; and
means for generating the drive signal in response to the signal propagating in the loop.

3. A musical tone synthesizing apparatus comprising:
(a) musical tone control means for generating performance information;
(b) musical tone drive signal generating means, connected to receive performance information from the musical tone control means, for generating a drive signal in accordance with performance information;
(c) musical tone forming means, connected to receive performance information from the musical tone control means, for forming a first musical tone signal in response to said performance information;
(d) first mixing means for mixing said drive signal and said first musical tone signal together by a first mixing ratio;
(e) resonance means for imparting a resonance effect to an output of said first mixing means to thereby produce a second musical tone signal; and
(f) second mixing means for mixing said first and second musical tone signals together by a second mixing ratio,
wherein an output of said second mixing means is picked up as a synthesized musical tone signal.

4. A musical tone synthesizing apparatus in accordance with claim 3 wherein said musical tone drive signal generating means is a loop circuit comprising:
nonlinear function generating means for receiving an input signal which is a function of performance information and generating an output signal having nonlinear input versus output characteristics; and
a signal path forming a loop and including means for introducing the output signal to the signal path and delay means for delaying a signal on the path by a predetermined delay interval, which delay interval determines the pitch of the musical tone; and
means for generating the drive signal in response to the signal propagating in the loop.

5. A musical tone synthesizing apparatus comprising:
(a) musical tone control means for generating performance information;
(b) musical tone drive signal generating means, connected to receive performance information from the musical tone control means, for generating a drive signal in accordance with performance information;
(c) musical tone forming means for forming a first musical tone signal based on said drive signal;
(d) first mixing means for mixing said drive signal and said first musical tone signal together, wherein at least one of said drive signal and said first musical tone signal is subject to a frequency-band limiting process before mixing;
(e) resonance means for imparting a resonance effect to an output of said first mixing means to thereby produce a second musical tone signal; and
(f) second mixing means for mixing said first and second musical tone signals together in accordance with said performance information,
wherein an output of said second mixing means is picked up as a synthesized musical tone signal.

6. A musical tone synthesizing apparatus in accordance with claim 5 wherein said musical tone drive signal generating means is a loop circuit comprising:
nonlinear function generating means for receiving an input signal which is a function of performance information and generating an output signal having nonlinear input versus output characteristics; and
a signal path forming a loop and including means for introducing the output signal to the signal path and delay means for delaying a signal on the path by a predetermined delay interval, which delay interval determines the pitch of the musical tone; and
means for generating the drive signal in response to the signal propagating in the loop.

* * * * *